US005299625A

United States Patent [19]

Miki

[11] Patent Number: 5,299,625

[45] Date of Patent: Apr. 5, 1994

[54] RISER SLEEVE WITH BREAKER CORE

[76] Inventor: Masamitsu Miki, No. 1-25-15, Nakahara, Mitakashi, Tokyo, Japan

[21] Appl. No.: 956,064

[22] Filed: Oct. 2, 1992

[30] Foreign Application Priority Data

Oct. 3, 1991 [JP] Japan ..... 3-80602

[51] Int. Cl.[5] ..... B22C 9/00

[52] U.S. Cl. ..... 164/359; 249/197

[58] Field of Search ..... 164/359, 360, 349, 363, 164/364; 249/105, 106, 197

[56] References Cited

U.S. PATENT DOCUMENTS 4,141,406 2/1979 Wukovich ..... 164/359
4,188,010 2/1980 Reiland ..... 164/359
4,574,869 3/1986 Trinkl ..... 164/360

*Primary Examiner*—Paula A. Bradley
*Assistant Examiner*—Erik R. Puknys
*Attorney, Agent, or Firm*—Wenderoth, Lind & Ponack

[57] ABSTRACT

A riser sleeve with a breaker core comprises a sectionally V-shaped riser sleeve having a bottom opening and a breaker core having a central opening and attached to the bottom of the riser sleeve. The inner diameter $D_3$ of the central opening of the neck-down core is substantially the same as the inner diameter $D_2$ of the bottom opening of the riser sleeve, and the outer diameter $D_5$ of breaker core is substantially the same as or larger than the outer diameter $D_4$ of the bottom of the riser sleeve. The riser sleeve with breaker core greatly reduces the amount of finishing that the cast product requires after casting.

10 Claims, 3 Drawing Sheets

RISER SLEEVE WITH BREAKER CORE

BACKGROUND OF THE INVENTION

1. Field of the Invention

This invention relates to a riser sleeve with breaker core for use in the casting of metals.

2. Description of the Prior Art

It is a common practice to use an exothermic or insulating riser sleeve with a ceramic breaker core, a sand breaker core or a breaker core made of heat insulating material attached to its bottom. This is especially true in the case of casting ductile iron, ordinary iron and steel. Although no particular problem is encountered when the riser sleeve is used in this manner for casting iron, in the casting of steels, particularly of special steels, the riser sleeve and breaker core 6 disposed in the sand mold 7 as shown in FIG. 3 before pouring of the melt are found to become as shown in FIG. 4 after pouring of the melt. Specifically, the bottom of the breaker core 6 is distorted upwardly, as indicated by the arrow E. While the attachment of the breaker core thus makes it easier to break off the riser 8, additional steps become necessary for eliminating the distortion occurring under the riser. The advantage of using the breaker core is offset by this disadvantage. Since the breaker core is therefore seldom used in casting special steels, considerable labor and cost is required for riser removal.

Further, if the sand mold is fabricated using a large diameter riser sleeve, as shown in FIG. 5, the sand packing becomes poor at the region indicated by the arrows B. Since this lowers the strength of the sand mold at this region, penetration of the melt is apt to occur.

On the other hand, one property required of the breaker core is that it exhibit excellent breakdown ability during the finish processing following completion of the casting. From this viewpoint, it is preferable to fabricate the breaker core using an organic binding material and, in fact, breaker cores fabricated using thermosetting phenol resin as a binding material are widely employed. Although these neck-down cores do not produce casting defects when used to cast iron and iron alloys, their use in casting steel leads to the occurrence of gas defects in the casting owing to nitrogen gas generated by the binding material. Breaker cores using acid hardening resin as the binding material are also employed. While these breaker cores present no problem as regards breakdown ability during finish processing following completion of the casting, the sulfur contained in the binding material gives rise to $SO_2$, which also produces gas defects in the casting. Other breaker cores fabricated using linseed oils, tung oil, soybean oil or other such drying oil as the binding material are also in use. These exhibit a fair degree of high-temperature strength and do not produce gas defects in the casting. However, the productivity of the breaker core is poor.

Breaker cores made of silicon sand can be used without any problem for casting iron and other metals with relatively low melting points. However, when used to cast high-melting point steel, they are deformed by the heat and pressure of the cast melt. As a result, bulges are formed on the casting.

SUMMARY OF THE INVENTION

The object of this invention is to provide a riser sleeve with breaker core which completely eliminates the aforesaid problems of the prior art.

The gist of the invention resides in:

(1) A riser sleeve with breaker core comprising a riser sleeve of V, U or like shape as viewed in section taken along its vertical axis and having a bottom opening, and a neck-down core attached to the bottom of the riser sleeve and having a central opening, the central opening of the breaker core having an inner diameter $D_3$ that is approximately the same as or slightly smaller than the inner diameter $D_2$ of the bottom opening of the riser sleeve, and the outer diameter $D_5$ of the breaker core being substantially the same as or larger than the outer diameter $D_4$ of the bottom of the riser sleeve.

(2) A riser sleeve with breaker core as set out in (1) above, wherein the periphery of the central opening of the breaker core is wedge shaped in vertical section.

(3) A riser sleeve with breaker core as set out in (1) or (2) above, wherein the breaker core consists of molding sand.

(4) A riser sleeve with breaker core as set out in (1) or (2) above, wherein the breaker core consists mainly of one or more relatively high specific gravity, high-melting point sands selected from among zircon sand, chromite sand and the like.

(5) A riser sleeve with breaker core as set out in any of (1) to (4) above, wherein the breaker core is fabricated using, as a binding material, a drying oil or an organic resin such as alkaline phenolic resin.

DETAILED DESCRIPTION OF THE PREFERRED EMBODIMENT

The invention will now be explained with reference to the drawings.

Figure 1:
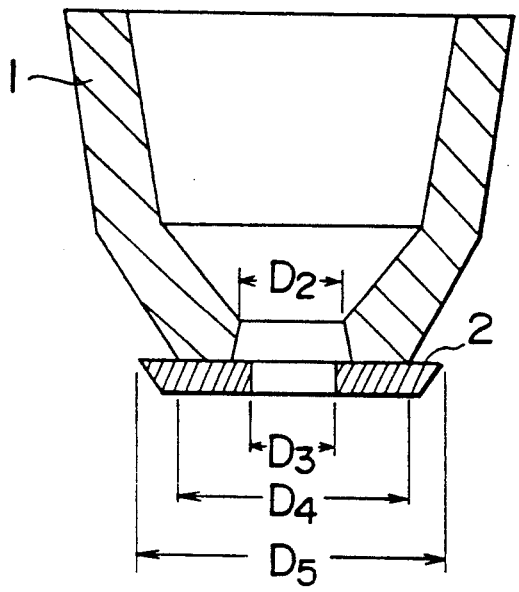
FIG. 1 is a sectional view showing an embodiment of the invention.

In the embodiment of the invention shown in the sectional view of FIG. 1, the riser with breaker core comprises a V-shaped riser sleeve 1 (which can alternatively be U-shaped) to the bottom of which is attached a breaker core 2 constituted of one or more of silicon sand, chromite sand and zircon sand. The inner diameter $D_2$ of the opening at the bottom of the riser sleeve 1 is made to be substantially equal to the inner diameter $D_3$ of the of the neck-down core.

Figure 2:
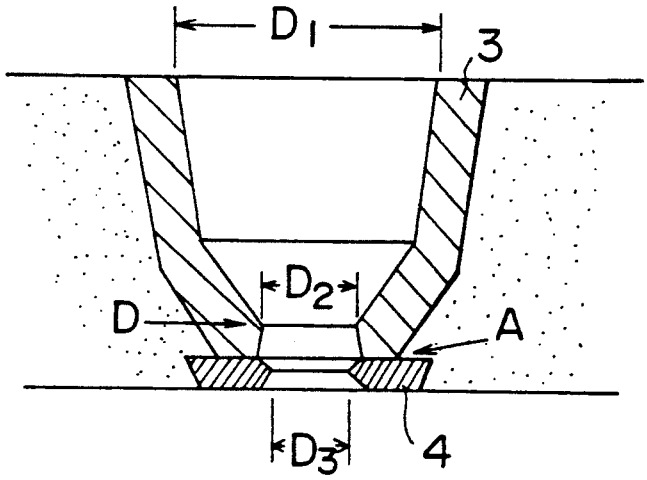
FIG. 2 is a sectional view showing another embodiment of the invention.
Figure 3:
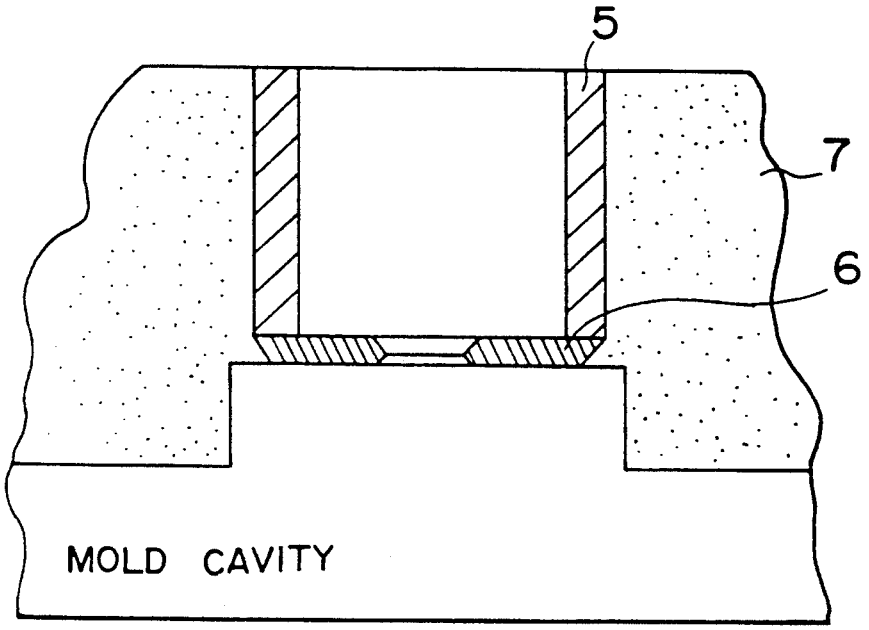
FIG. 3 PRIOR ART
FIG. 3 is a sectional view showing how a breaker core and a riser sleeve of a conventional type are disposed in a sand mold.
Figure 4:
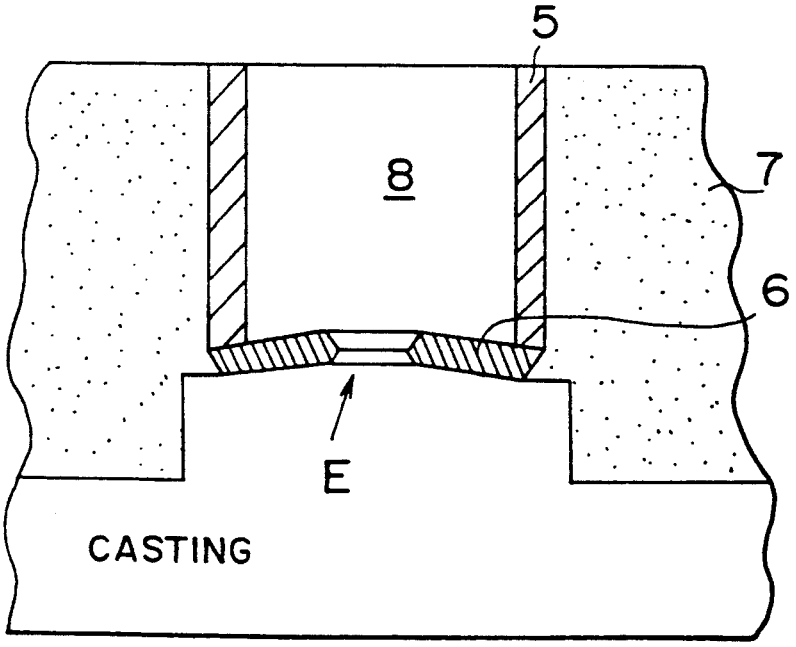
FIG. 4 PRIOR ART
FIG. 4 is a sectional view showing how a breaker core distorts upward when casting is conducted using a breaker core and a riser sleeve of the conventional type.

In the second embodiment of the invention shown in the sectional view of FIG. 2, the breaker core 4 attached to the bottom of the riser sleeve 3 has the inner periphery of its central opening formed to be wedge shaped in vertical section and the inner diameter $D_2$ of the opening at the bottom of the riser sleeve 3 is about equal to the inner diameter $D_3$ of the wedge-shaped portion of the breaker core 4.

When a breaker core of one of the foregoing types is used for casting high manganese steel, for example, the riser (inner diameter: 200 mm) of the high manganese steel casting can be easily broken off the casting with a hammer. Moreover, the surface of the casting in contact with the breaker core exhibits no bulging whatsoever. This greatly reduces the finish processing required by the casting.

Moreover, as shown in FIGS. 1 and 2, in accordance with the invention, the outer diameter $D_5$ of the breaker core 2, 4 is generally made larger than the outer diameter $D_4$ of the riser sleeve 1, 3. That is, the breaker core 2, 4 is formed so as to project laterally beyond the bottom edge of the riser sleeve 1, 3. This is not absolutely necessary when a relatively thick breaker core is used, however, since a thick breaker core experiences little deformation. In such cases, it suffices for the outer diameter $D_5$ of the breaker core 2, 4 to be equal to the outer diameter $D_4$ of the riser sleeve 1, 3. On the other hand, use of an excessively thick breaker core causes the melt to cool more rapidly near the central opening of the breaker core at the time it is poured for casting. Since the cooled melt solidifies and reduces the diameter of the central opening, it becomes increasingly difficult to pour the melt into the mold. Because of this, it is necessary to establish the following relationship between the inner diameter $D_3$ of the central opening of the breaker core and the thickness a of the neck-down core:

$$1/20 < a/D_3 < 2$$

The advantages obtained from the aforesaid structure of the riser sleeve with breaker core according to this invention will now be explained.

(1) Since the contact area between the lower surface of the breaker core and the upper surface of the casting is reduced, upward distortion of the breaker core does not occur.

Moreover, as shown in FIG. 2, the restraining action of the projecting portion A of the breaker core 4 and the restraining action of the riser sleeve 3 itself at the portion D thereof work to prevent upward distortion of the breaker core at the time of casting the melt into the riser sleeve and the breaker core. As a result, upward bulging of the surface of the casting in contact with the bottom of the riser sleeve is prevented. In addition, the reduced diameter of the breaker core and the downward taper of the riser sleeve make it possible to reduce the diameter at the bottom of the riser by 85% or more. This makes the riser very easy to break off.

(2) As the riser sleeve does not directly contact the casting surface, hardening of the upper casting surface by entrainment of Al, Si and other impurities from the riser sleeve is prevented.

Figure 5:
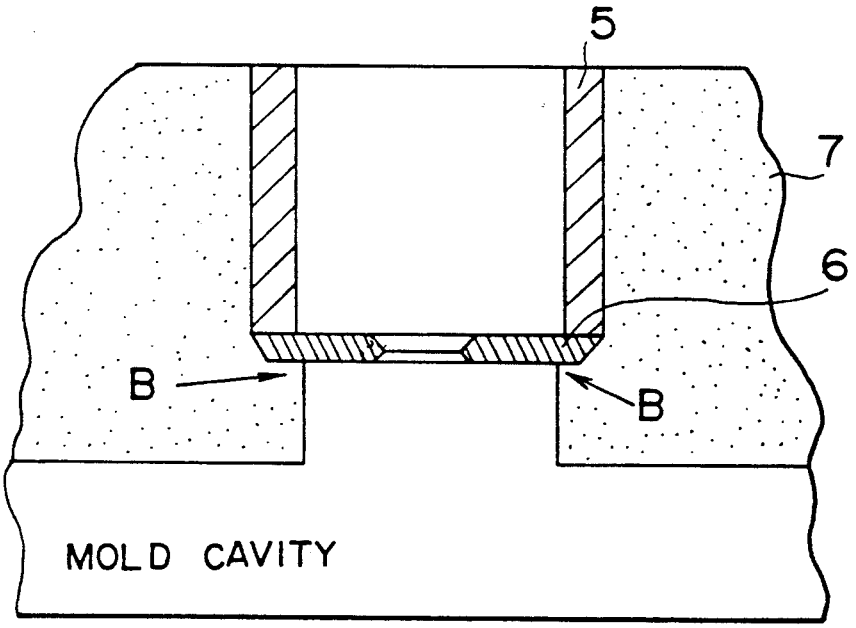
FIG. 5 PRIOR ART
FIG. 5 is a sectional view showing how a breaker core and a riser sleeve of the conventional type are disposed in a sand mold.

(3) Since the riser sleeve is of V, U or like shape as viewed in section taken along its vertical axis, there is no problem of the poor sand packing that may occur with the conventional riser sleeve, as indicated at B in FIG. 5. Penetration of the melt to the casting surface is thus prevented.

(4) Since the water-soluble alkaline phenolic resin used as the binding material for fabricating the neck-down core does not contain nitrogen or sulfur, no nitrogen or $SO_2$ gas is produced at the time of casting. The casting therefore does not sustain gas defects. Further, use of methyl formate gas as a hardener makes it possible for the breaker core to be fabricated by the gas forming method, which does not require drying. This markedly increases the productivity of the breaker core and effectively reduces the cost of its fabrication. It also results in a neck-down core with good high-temperature strength which does not deform after casting and which exhibits excellent breakdown ability during the finish processing after casting.

EXAMPLE 1

A breaker core formed of zircon sand added with linseed oil and dried at 300° C. was attached to the bottom of a sectionally V-shaped riser sleeve having an inner diameter of 180 mm. When the result was used for casting high manganese steel, there was no occurrence of the upward bulging of the casting surface under the breaker core that occurs when a conventional breaker core is used. In addition, the diameter of the bottom of the riser was reduced by 85% relative to that in conventional casting. As a result, the time and cost required for removing the riser was greatly reduced (by about 80%), and there was obtained a defect-free cast product. Moreover, no pinholes (gas defects) of the type that occur with the use of a conventional ceramic breaker core were observed under the breaker core.

EXAMPLE 2

A breaker core formed of chromite sand added with water-soluble alkaline phenolic resin and hardened with formate gas was attached to the bottom of a sectionally V-shaped riser sleeve having an inner diameter of 220 mm. When the result was used for casting chrome-molybdenum steel, the upward bulging of the breaker core per se observed when a conventional breaker core is used did not occur. In addition, as the diameter of the bottom of the riser was reduced by 85% relative to that in conventional casting, the riser could be easily broken off with a hammer. Moreover, it was possible to achieve a casting yield of 84%, to reduce the cost of finishing the casting greatly (by about 80%), and obtain a cast steel product that was totally free of defects under the core. Nor were any pinholes (gas defects) observed. What is more, since the fabrication of the neck-down core of this example did not require a drying process and could therefore be completely automated, high productivity and good adaptability to volume production were realized, opening the way to low-cost production.

Since the riser sleeve with breaker core according to this invention prevents bulging of the casting surface in contact with the breaker core, it enables a major reduction in the finish processing required by the casting.

Differently from the conventional ceramic breaker core which, being deficient in air permeability and exhibiting very poor gas-escape property, causes pinholes to form in the casting surface in contact with the breaker core, the breaker core according to this invention, being formed of casting sand, totally prevents the occurrence of such gas defects.

Since the inner diameter $D_2$ at the bottom of the riser sleeve is smaller than the inner diameter $D_1$ at the top thereof, the portion of the sleeve designated by the arrow D in FIG. 2 becomes relative thick so that heating and heat retention is promoted at the reduced-diameter part of the sleeve. Thus, accelerated cooling of the melt at the reduced-diameter part of the sleeve can be prevented even after attachment of the breaker core. As a result, shrinkage does not occur at or under the breaker core.

Since the casting surface in contact with the breaker core exhibits a highly clean finish free of burning, gas defects and other flaws, the casting can be used as a final product without any particular need for grinder finishing.

What is claimed is:

1. An apparatus, comprising:

a riser sleeve having a vertical axis, a bottom with an outer diameter $D_4$, a bottom opening having an inner diameter $D_2$, and a V shape, as viewed in a section taken along the vertical axis, that tapers toward said bottom opening; and a breaker core attached to said bottom of said riser sleeve, said breaker core having a central opening with an inner diameter $D_3$ that is substantially the same as same inner diameter $D_2$ of said bottom opening of said riser sleeve, and said breaker core having an outer diameter $D_5$ that is larger than said outer diameter $D_4$ of said bottom of said riser sleeve.

2. The apparatus of claim 1, wherein said central opening has a periphery shaped in the form of a wedge as viewed in a section taken along the vertical axis.

3. The riser sleeve of claim 1 or 2, wherein said breaker core is made of molding sand.

4. The riser sleeve of claim 1 or 2, wherein said breaker core comprises at least one high specific gravity and high melting point sand selected from the group consisting of zircon sand and chromite sand.

5. An apparatus, comprising:

a riser sleeve having a vertical axis, a bottom with an outer diameter $D_4$, a bottom opening having an inner diameter $D_2$ and a top having an inner diameter $D_1$, wherein said inner diameter $D_1$ is larger than said inner diameter $D_2$; and a breaker core attached to said bottom of said riser sleeve, said breaker core having a central opening with an inner diameter $D_3$ that is substantially the same as said inner diameter $D_2$ of said bottom opening of said riser sleeve, and said breaker core having an outer diameter $D_5$ that is the same as or larger than said outer diameter $D_4$ of said bottom of said riser sleeve.

6. The apparatus of claim 5, wherein said riser sleeve is thicker at said inner diameter $D_2$ than at said inner diameter $D_1$.

7. The apparatus of claim 5, wherein said breaker core has an inner peripheral surface, defining said central opening, that tapers inwardly from both upper and lower sides of said breaker core to a point on said inner peripheral surface having said inner diameter $D_3$.

8. The apparatus of claim 5 or 7, wherein said breaker core is made of molding sand.

9. The apparatus of claim 8, wherein said breaker core is further made with a binding material selected from the group consisting of a drying oil and an organic resin.

10. The apparatus of claim 9, wherein said organic resin is an alkaline phenolic resin.

* * * * *